US009216362B2

(12) United States Patent
Hague et al.

(10) Patent No.: US 9,216,362 B2
(45) Date of Patent: Dec. 22, 2015

(54) WATER FROLIC APPARATUS

(71) Applicants: Corbin C. Hague, Scottsdale, AZ (US); Gregory D. Hague, Scottsdale, AZ (US); William J. Stafford, Scottsdale, AZ (US)

(72) Inventors: Corbin C. Hague, Scottsdale, AZ (US); Gregory D. Hague, Scottsdale, AZ (US); William J. Stafford, Scottsdale, AZ (US)

(73) Assignee: Flexground Products, LLC, Tempe, AZ (US)

( * ) Notice: Subject to any disclaimer, the term of this patent is extended or adjusted under 35 U.S.C. 154(b) by 277 days.

(21) Appl. No.: 13/952,546

(22) Filed: Jul. 26, 2013

(65) Prior Publication Data

US 2014/0027544 A1 Jan. 30, 2014

Related U.S. Application Data

(60) Provisional application No. 61/676,996, filed on Jul. 29, 2012.

(51) Int. Cl.

| | |
|---|---|
| ***A63H 23/10*** | (2006.01) |
| ***B05B 1/20*** | (2006.01) |
| ***B05B 17/08*** | (2006.01) |
| ***A63G 31/00*** | (2006.01) |

(52) U.S. Cl.

CPC ..... *A63H 23/10* (2013.01); *A63G 31/007* (2013.01); *B05B 1/202* (2013.01); *B05B 17/08* (2013.01); *Y10T 29/49002* (2015.01)

(58) Field of Classification Search

CPC ..... B05B 1/202; B05B 17/08; A63H 23/10

See application file for complete search history.

(56) References Cited

U.S. PATENT DOCUMENTS

| | | | | |
|---|---|---|---|---|
| 2,757,960 | A * | 8/1956 | Hatcher | 239/229 |
| 4,805,898 | A | 2/1989 | Jacober et al. | |
| 4,982,959 | A * | 1/1991 | Rudell et al. | 273/443 |
| 5,135,440 | A | 8/1992 | Smollae et al. | |
| 5,194,048 | A | 3/1993 | Briggs | |
| 5,683,314 | A | 11/1997 | Musso | |
| 5,862,990 | A | 1/1999 | White | |
| 5,967,901 | A | 10/1999 | Briggs | |
| 6,089,987 | A | 7/2000 | Briggs | |
| 6,592,055 | B1 | 7/2003 | Marino | |
| 6,702,687 | B1 | 3/2004 | Henry | |
| 7,179,173 | B2 | 2/2007 | Henry et al. | |
| 7,318,762 | B2 | 1/2008 | Goldmeier | |
| 7,475,832 | B2 | 1/2009 | Amron | |
| 7,606,637 | B2 * | 10/2009 | Habing | 700/284 |
| 7,682,259 | B1 | 3/2010 | Edwards | |
| 7,980,914 | B1 | 7/2011 | Blais et al. | |
| 2002/0042660 | A1 | 4/2002 | Atkinson | |
| 2003/0073505 | A1 * | 4/2003 | Tracy | 472/128 |
| 2005/0167625 | A1 * | 8/2005 | Deen | 251/129.04 |
| 2006/0208101 | A1 * | 9/2006 | DeBoer et al. | 239/16 |

* cited by examiner

*Primary Examiner* — Ryan Reis
(74) *Attorney, Agent, or Firm* — Morgan Law Offices, PLC

(57) ABSTRACT

A water frolic apparatus is provided comprising a power supply; a controller electrically connected to the power supply, the controller capable of operating a valve; the valve having an inlet and an outlet, the inlet attachable to a water supply from a hose and the outlet attachable to plastic tubing, wherein operation of the valve controls flow of water; and a plurality of pods, each of the pods having a first hole that accepts entry of the tubing and a second hole allowing water from the tubing to spurt through. The pods are connected in series, wherein, except for the last pod in the series, the tubing extends through the entire length of each of the pods to the next pod. In an embodiment, the controller is configured to open the valve at a set interval or a pseudo-random interval.

17 Claims, 5 Drawing Sheets

WATER FROLIC APPARATUS

CROSS-REFERENCE TO RELATED APPLICATIONS

This application claims the benefit of U.S. Provisional Ser. No. 61/676,996 to Hague et al., entitled PORTABLE WATER FROLIC APPARATUS, filed Jul. 29, 2012, the subject matter of which is incorporated herein by reference.

BACKGROUND OF THE INVENTION

1. Field of the Invention

The present invention relates to outdoor amusement devices and, more particularly, to a water frolic apparatus.

2. Description of the Related Art

Young children are fascinated by water and enjoy playing in water outside. The simplest "water play" device is the garden hose. However, a drawback is that the hose either must be constantly held by an adult or propped up which can result in children frequently knocking it over.

Another common water play device is a water sprinkler. Children enjoy frolicking in the water that gently sprays from these devices. However, such devices may not be suitable for groups of children since it is difficult for more than one child at a time to get sprayed.

Various other water play devices have been invented. On a larger scale, some parks have permanently installed sprinklers with water nozzles/jets. These devices require proper plumbing, and are expensive to install and maintain. However, they are appropriate for their intended purpose.

There have also been water play devices suitable for residential use such as the one disclosed in U.S. Pat. No. 7,606,637 to Habing. Habing describes a water play system wherein water is supplied to a plurality of sprinkler stations. Each sprinkler has a solenoid-controlled valve powered via an electrical cord running to it. Although children will have fun using such a device, Habing suffers from an overly complex and potentially unsafe design.

SUMMARY OF THE INVENTION

One aspect of the disclosure relates to a water frolic apparatus, comprising a power supply; a controller electrically connected to the power supply, the controller capable of operating a valve; the valve having an inlet and an outlet, the inlet attachable to a water supply from a hose and the outlet attachable to plastic tubing, wherein operation of the valve controls flow of water; and a plurality of pods, each of the pods having a first hole that accepts entry of the tubing and a second hole allowing water from the tubing to spurt through. The pods are connected in series, wherein, except for the last pod in the series, the tubing extends through the entire length of each of the pods to the next pod. The apparatus is structured so as not to allow water to flow through a distal end of the tubing. The water supply is preferably pressurized, wherein the inlet is connectable to a hose attached to an outside faucet.

In an embodiment, the controller is configured to open the valve at a set interval or a pseudo-random interval. In the latter case, the water would spurt from the pods in a 'random' manner.

In an embodiment, the pods are made of an impact absorbing rubberized material, such as thermo plastic vulcanized (TPV) rubber. In this embodiment, for safety, the pods assume a relatively low profile (e.g., are no more than about two inches in height). The pods can be any regular geometric shape (e.g., cylindrical, cubic) or other shape (e.g., animal-shape, flower-shape, etc.)

In an embodiment, the valve is an electromechanically operated valve operated by the controller, for example, a valve operated by the controller by applying an electric current through a solenoid.

In an embodiment, a T-connector is disposed in each of the pods wherein a left opening of the T-connector connects a first segment of the tubing, a right opening of the T-connector connects a second segment of the tubing, and a middle opening of the T-connector is unconnected allowing the water to spurt from the second hole in the pod. To facilitate the water to spurt high into the air, the inside diameter of the unconnected middle opening of the T-connector is relatively small, preferably at least about 20% less than the inside diameters of the other openings.

DETAILED DESCRIPTION OF THE INVENTION

Figure 1:
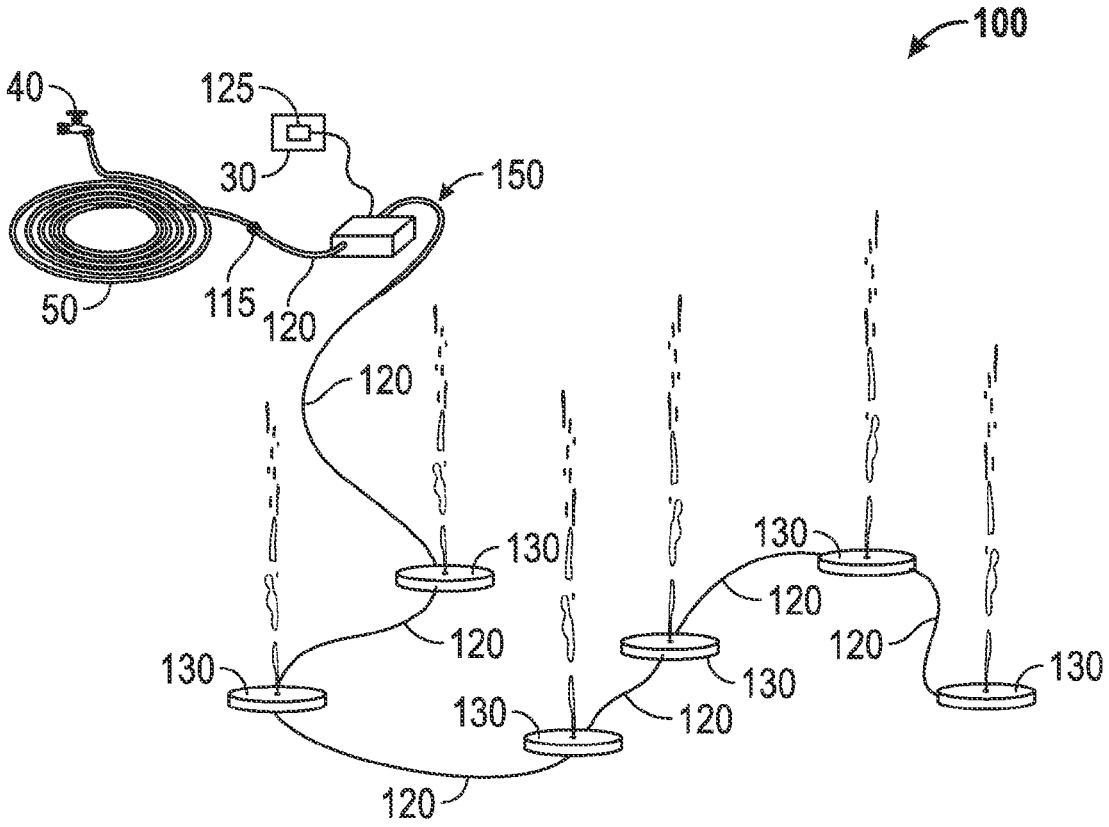
FIG. 1 illustrates an exemplary water frolic apparatus, in accordance with an embodiment of the invention.

Referring to FIG. 1, an exemplary water frolic apparatus 100, according to an embodiment of the invention, is shown. As depicted, the water frolic apparatus 100 includes a water distributor 150 electrically connected to a power supply 125 (which is plugged into an outdoor electrical outlet 125). As will be described in greater detail, the water distributor 150 controls flow of water supplied from a hose 50 attached to an outdoor faucet (bib) 40 through plastic tubing 120. The plastic tubing carries the water to each of a plurality of pods 130 arranged in series, wherein a portion of the water is allowed to spurt from each of the pods 130, as shown. The apparatus 100 is structured so as not to allow water to flow through a distal end of the tubing 120. In an embodiment, the water distributor 150 is configured to cause the water to spurt from the pods 130 at a set interval (e.g., for two seconds, then a half-second pause) or a pseudo-random interval. In the latter case, the water would spurt from the pods 130 in a 'random' manner which has been found to be both exciting and amusing to small children.

In the illustrated embodiment, the hose 50 is not directly connected to an inlet of the water distributor 150. Instead, the hose 50 is connected to plastic tubing 120 via a hose connector 115. In this embodiment, the inside diameter of the hose is substantially greater than the inside diameter of the plastic tubing 120. It is to be understood that, alternately, a connector for connecting the plastic tubing 120 directly to the outdoor faucet 40 may be used. In another embodiment, the hose 50 is connected to an inlet of the water distributor 150.

Figure 2:
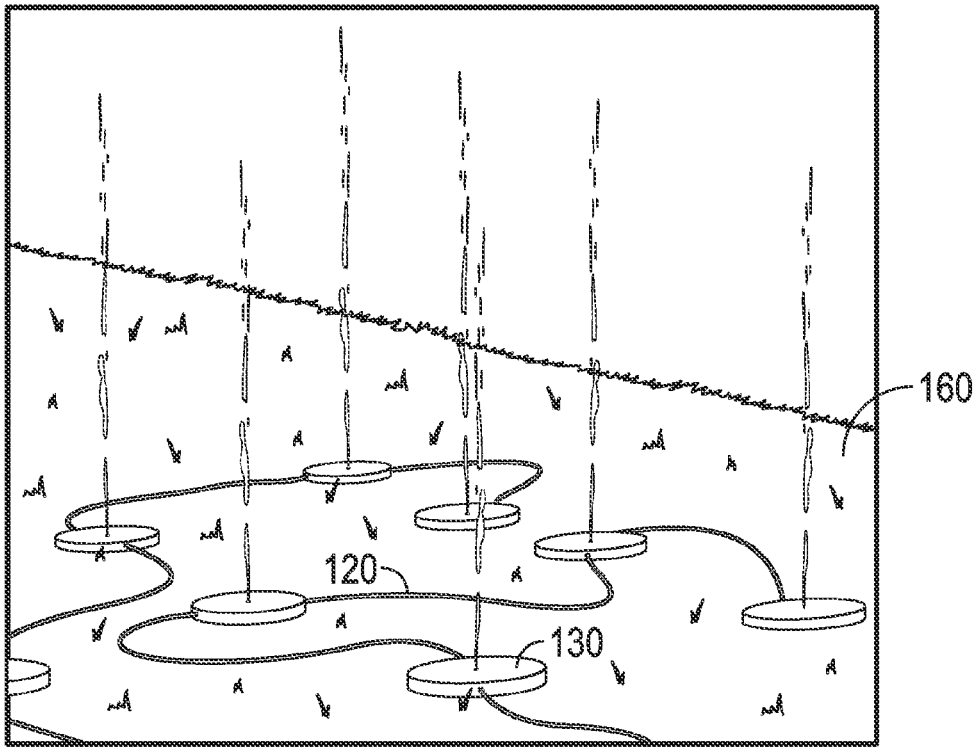
FIG. 2 illustrates an implementation of the water frolic apparatus wherein pods are installed on top of a ground surface.
Figure 3:
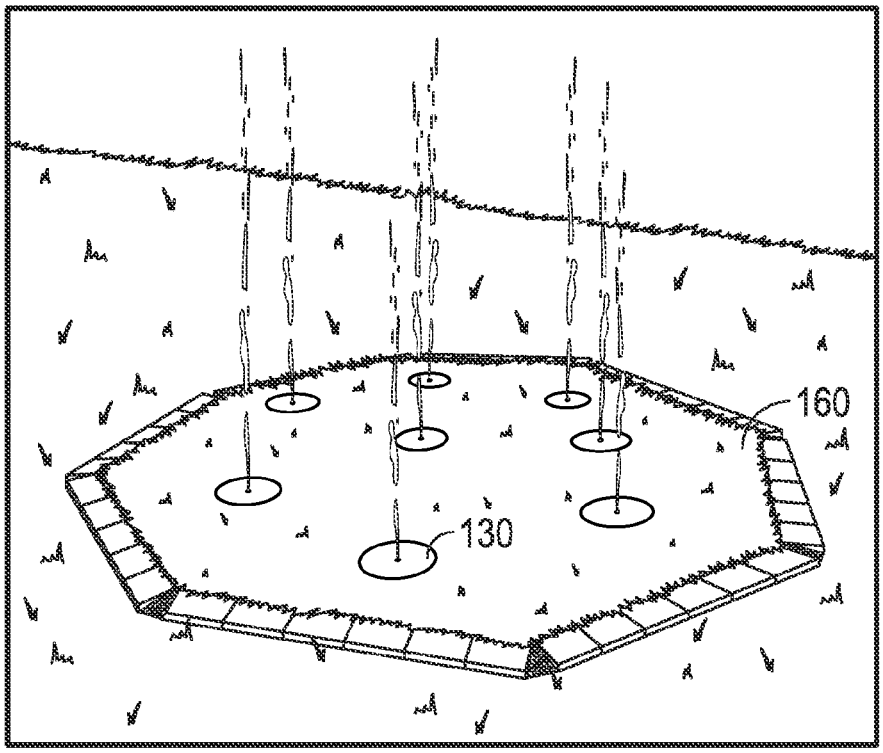
FIG. 3 illustrates an implementation of the water frolic apparatus wherein pods are embedded in a ground surface.

FIG. 2 illustrates an implementation of the water frolic apparatus 100 installed on top of a ground surface 160. In this embodiment both the pods 130 and the plastic tubing 120 are arranged on top of the ground surface 160. FIG. 3 illustrates another implementation in which pods 130 and the plastic tubing 120 are embedded in a ground surface 160. In this embodiment, the lateral sides of the pods 130 are placed into the ground with the top surfaces of the pods 130 exposed. The ground surface 160 can include grass, sand, gravel, wood chips, etc., or even a solid material such as concrete.

Figure 4A:
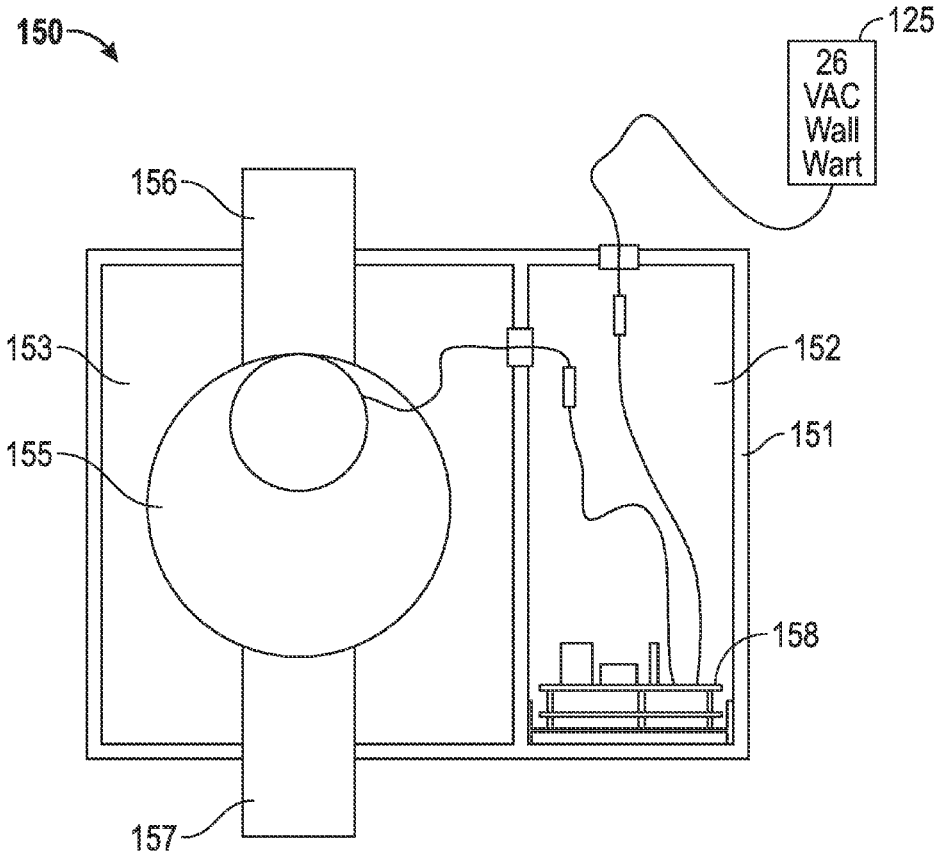
FIG. 4A illustrates a top view of an exemplary water distributor useable to control operation of the water frolic apparatus.
Figure 4B:
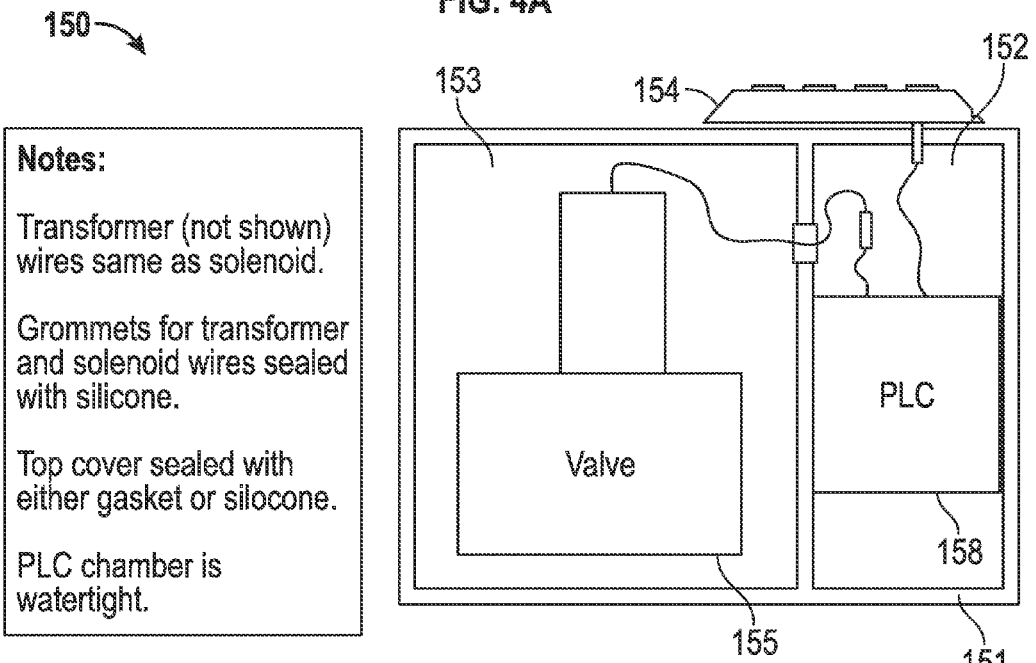
FIG. 4B illustrates a side view of the water distributor useable to control operation of the water frolic apparatus.

FIG. 4A illustrates a top view of an exemplary water distributor 150 to control operation of the water frolic apparatus 100. As shown, the water distributor 150 includes a housing 151 having a first compartment 152 and a second compartment 153, both of which are water sealed with a gasket and/or silicone, for example. Referring to FIG. 4B, attached on top of the housing 151 is a switch 154 which is electrically connected to the power supply 125 and a programmable logic controller (PLC) 158 through a sealed hole in the first compartment 152. The PLC 158 is electrically connected to an electromechanically operated valve 155 through a hole into the second compartment 153.

The electromechanically operated valve 155 is operated by the PLC 158. For example, the electromechanically operated valve 155 can be a solenoid-controlled valve operated by applying an electric current through a solenoid in the electromechanically operated valve 155 which causes the valve to open or close. A suitable electromechanically operated valve 155 useable in conjunction with the present invention is one of the 2400/2600 series model valves by Irritrol Systems, of Riverside, Calif. The PLC 158 is a programmed device which can be configured in many different ways to control operation of the solenoid-controlled valve 155. In an embodiment, the switch 154 includes four (4) buttons: the first button for setting a constant flow of water; the second button for operating the water flow every 2 seconds, the third button for pseudo-random operation; and the fourth button to turn the device off. A suitable switch 154 is the Storm Interface 4 key pad part no. GS040203 by Keymat Technology Ltd. of Middlesex, UK. In another embodiment (not shown) the switch 154 can include one or more dial to set the intervals for operation of the water flow. Preferably, in this embodiment dual dials can be employed wherein the first dial is used to set the length of time for the valve to stay open and the second dial to set the length of time between valve openings. In an embodiment, the power supply 125 can be battery powered and/or solar powered.

Figure 5A:
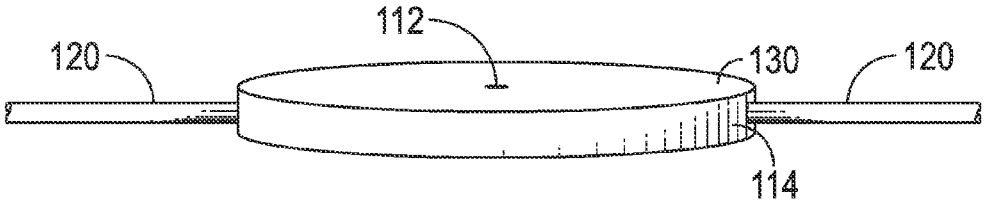
FIG. 5A illustrates a side perspective view of an exemplary pod useable in conjunction with the water play apparatus.

FIG. 5A illustrates a side perspective view of an exemplary pod 130 useable in conjunction with the water play apparatus 100. In an embodiment, the body 114 of each of the pods 130 is made of an impact absorbing rubberized material, such as thermo plastic vulcanized (TPV) rubber. In other embodiments, the body 114 of the pods 130 can be another plastic material or other suitable durable material, including concrete, metal, ceramic, etc. In the illustrated embodiment, the pods 130 assume a relatively low profile (e.g., are no more than about two inches in height). The pods 130 can be any regular geometric shape (e.g., cylindrical, cubic) or other shape (e.g., animal-shape, flower-shape, etc.)

Figure 5B:
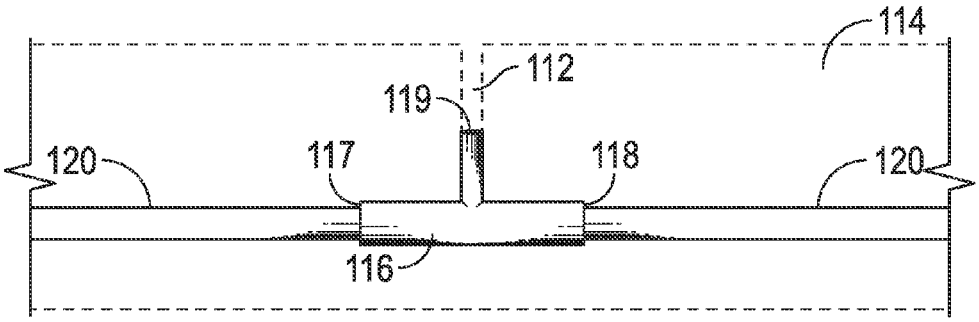
FIG. 5B illustrates a side cutaway view showing the internal tubing within the pod, according to an embodiment of the invention.
Figure 5C:
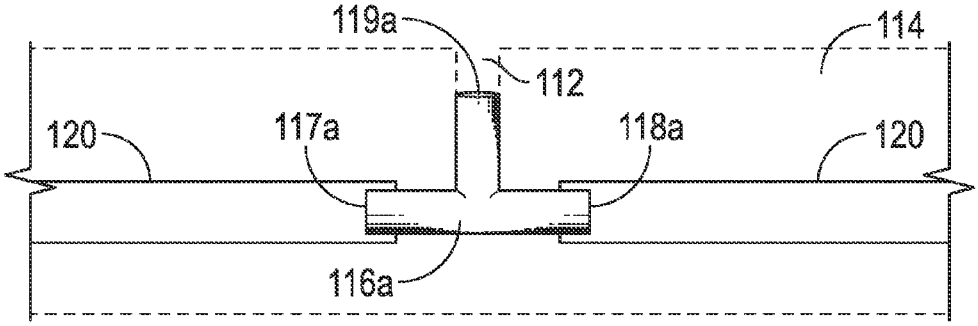
FIG. 5C illustrates a side cutaway view showing the internal tubing within the pod, according to another embodiment of the invention.

FIG. 5B illustrates a side cutaway view showing the internal tubing 120 within the pod 130, according to an embodiment of the invention. In an embodiment, a T-connector 160 is disposed in each of the pods 130 wherein the left opening 117 of the T-connector connects a first segment of the tubing 120, a right opening 118 of the T-connector connects a second segment of the tubing, and a middle opening 119 of the T-connector is unconnected allowing the water to flow through the middle opening 119 and spurt from the second hole 112 in the pod 130. To facilitate the water to spurt high into the air, the inside diameter of the unconnected middle opening 119 of the T-connector is relatively small, preferably at least about 20% less than the inside diameters of the openings 117, 118. As shown in FIG. 5B, the T-connector 160 is a reducing T-connector wherein the left opening 117 and the right opening 118 have inside diameters (e.g., ⅜ inch) that are substantially larger than the inside diameter of the middle opening 119 (e.g., ¼ inch). FIG. 5B illustrates a side cutaway view showing the internal tubing within the pod, according to another embodiment of the invention. In this embodiment, the T-connector 116*a* is not a reducing T-connector; rather, the left opening 117*a*, right opening 118*a*, and the middle opening 119*a* have substantially the same inside diameter (e.g., ¼ inch) but the plastic tubing 120 attached to the T-connector 116*a* has an inside diameter substantially larger (e.g., ⅜ inch). As shown, the tubing 120 fits over the outside perimeter of each of the left opening 117*a* and the right opening 118*a*.

Figure 6A:
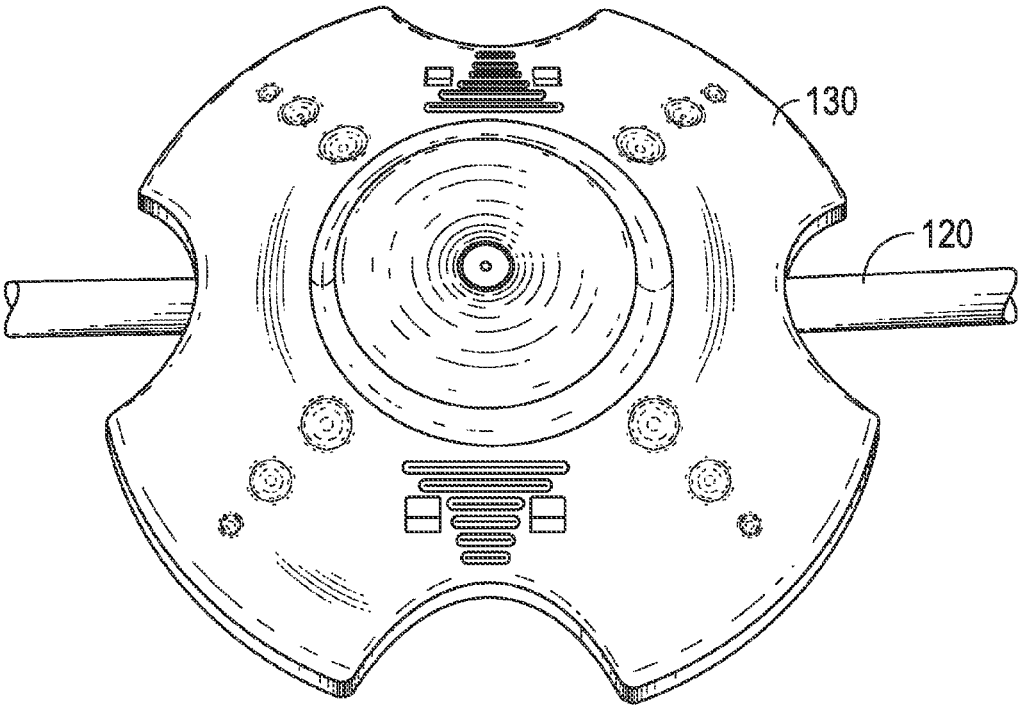
FIG. 6A illustrates a top view of another embodiment of an exemplary pod useable in conjunction with the water play apparatus.
Figure 6B:
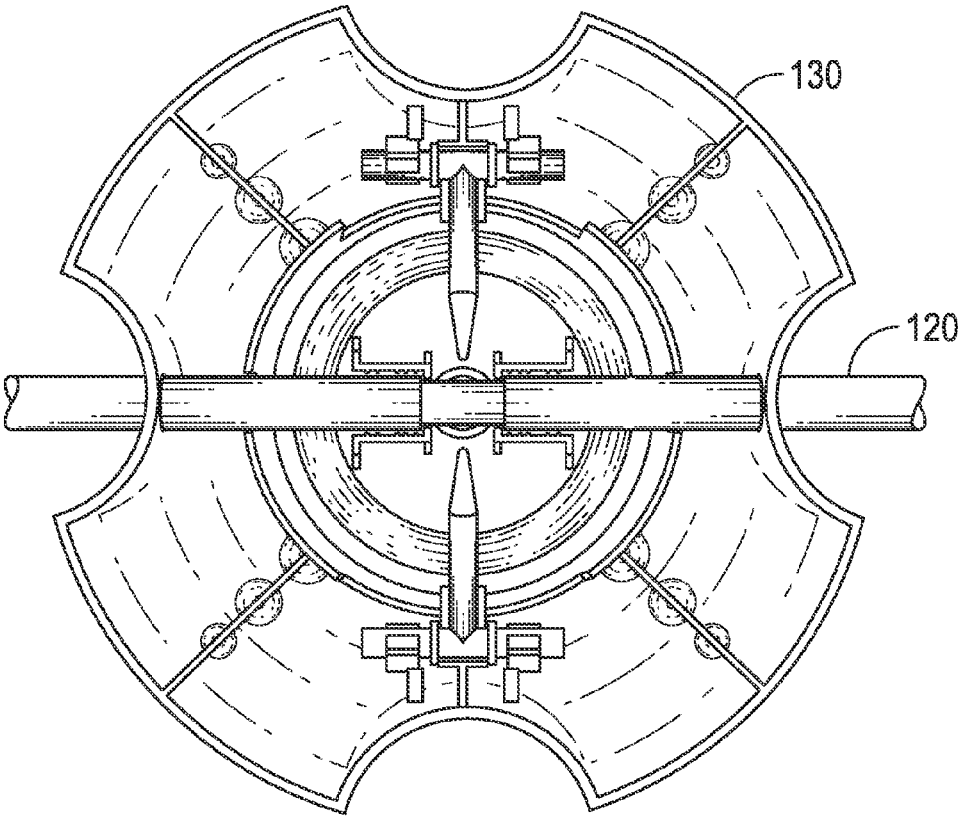
FIG. 6B illustrates a bottom view of the exemplary pod of FIG. 6A.

FIGS. 6A-B illustrate views of another embodiment of a pod 130 useable in conjunction with the water play apparatus 100. As shown, the pod 130 is made from a molded thermoplastic material such as polyethylene (PE), polypropylene (PP) or polyvinyl chloride (PVC). Such material has the advantage of being inexpensive and easy to manufacture. As shown, in FIG. 6B, the bottom of the pod includes a clip to securely hold the tubing in place.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A portable water frolic apparatus, comprising:

a power supply;

a controller electrically connected to the power supply, the controller capable of operating a valve;

the valve having an inlet and an outlet, the inlet attachable to a water supply and the outlet attachable to tubing, wherein operation of the valve controls flow of water;

the tubing; and a plurality of pods connected in series, each of the pods having a first hole that accepts entry of the tubing and a second hole allowing water from the tubing to spurt through;

wherein, except for the last pod in the series, the tubing extends through the length of each of the pods to the next pod in the series; and wherein each of the pods further includes disposed therein a T-connector, the T-connector comprising a single T-shaped cylindrical tubular device having a left tube portion, a right tube portion and a middle tube portion, the left tube portion, the right tube portion and the middle tube portion having substantially uniform diameters their entire respective lengths, the right tube portion and the left tube portion substantially parallel and directly connecting with each other so as to touch, and the middle tube portion directly connecting so as to touch the left tube portion and the right tube portion substantially perpendicularly, wherein the left tube portion of the T-connector connects a first segment of the tubing, the right tube portion of the T-connector connects a second segment of the tubing, and the middle tube portion of the T-connector cylindrical tube is unconnected allowing the water to spurt from the second hole in the pod, and wherein the inside diameter of the first segment of the tubing is at least about 25% greater than the inside diameter of the middle tube portion of the T-connector.

2. The apparatus of claim 1, wherein the apparatus is structured so as not to allow water to flow through a distal end of the tubing.

3. The apparatus of claim 1, wherein the water supply is pressurized.

4. The apparatus of claim 1, wherein the inlet is connectable to water from a hose attached to an outside faucet.

5. The apparatus of claim 1, wherein the pods are made of an impact absorbing rubberized material.

6. The apparatus of claim 5, wherein the impact absorbing rubberized material includes thermo plastic vulcanized (TPV) rubber.

7. The apparatus of claim 1, wherein the valve is an electromechanically operated valve operated by the controller.

8. The apparatus of claim 7, wherein the controller operates the valve by applying an electric current through a solenoid.

9. The apparatus of claim 1, wherein the pods are each no more than about two inches in height.

10. The apparatus of claim 1, wherein the pods are substantially cylindrical.

11. The apparatus of claim 1, wherein the controller is configured to open the valve at a pseudo-random interval.

12. The apparatus of claim 1, wherein the controller includes dual dials comprising a first dial to set length of time for the valve to remain open and a second dial to control to set length of time for the valve to remain closed between openings.

13. The apparatus of claim 1, wherein the pressure of the water flowing from the outlet is substantially greater than the pressure of the water flowing from the water supply.

14. A portable water frolic apparatus, comprising:

an electromechanical valve having an inlet and an outlet, the inlet attachable to a water source and the outlet attachable to tubing, wherein operation of the valve controls flow of water;

a controller electrically connectable to a power supply, the controller capable of operating the valve;

the tubing; and a plurality of pods arranged in series, each of the pods having a first hole that accepts entry of the tubing and a second hole allowing water from the tubing to spurt through;

wherein each of the pods further includes disposed therein a T-connector, the T-connector comprising a single T-shaped cylindrical tubular device having a left tube portion, a right tube portion and a middle tube portion, the left tube portion, the right tube portion and the middle tube portion having substantially uniform diameters their entire respective lengths, the right tube portion and the left tube portion substantially parallel and directly connecting with each other so as to touch, and the middle tube portion directly connecting so as to touch the left tube portion and the right tube portion substantially perpendicularly, wherein the left tube portion of the T-connector connects a first segment of the tubing, the right tube portion of the T-connector connects a second segment of the tubing, and the middle tube portion of the T-connector cylindrical tube is unconnected allowing the water to spurt from the second hole in the pod, and wherein the inside diameter of the first segment of the tubing is at least about 25% greater than the inside diameter of the middle tube portion of the T-connector.

15. A method of installing the portable water frolic apparatus of claim 14, comprising:

electrically connecting the controller to the power supply;

connecting the water source to the inlet, the water source including a hose connected to an outside faucet;

connecting the tubing to the outlet;

laying the pods on a ground surface; and connecting the tubing to the pods.

16. The apparatus of claim 1, wherein the controller is configured to open the valve at a user-selected interval.

17. The apparatus of claim 1, wherein the left tube portion of the T-connector and the right tube portion of the T-connector connect to the first segment of the tubing and the second segment of the tubing, respectively, without use of threading.

* * * * *